US006012718A

United States Patent [19]

McClellan

[11] Patent Number: 6,012,718

[45] Date of Patent: Jan. 11, 2000

[54] PUZZLE

[76] Inventor: Willa McClellan, 345 Martha Ave., Buffalo, N.Y. 14215

[21] Appl. No.: 09/089,347

[22] Filed: Jun. 3, 1998

Related U.S. Application Data

[60] Provisional application No. 60/048,527, Jun. 4, 1997.

[51] Int. Cl.[7] ..... A63F 9/10

[52] U.S. Cl. ..... 273/157 R

[58] Field of Search ..... 273/157 R, 156, 273/153 R; 434/159, 160, 171, 172, 176; D21/480

[56] References Cited

U.S. PATENT DOCUMENTS

| | | | |
|---|---|---|---|
| D. 212,242 | 9/1968 | Paulus | 273/157 R |
| 1,230,263 | 6/1917 | Alexander . | |
| 1,245,475 | 11/1917 | Lindheim | 434/159 |
| 1,276,344 | 8/1918 | Gilman . | |
| 1,439,336 | 12/1922 | Smith | 273/157 R |
| 1,477,322 | 12/1923 | Degheri . | |
| 1,752,248 | 3/1930 | Fransen | 273/157 R |
| 1,854,999 | 4/1932 | Ralls . | |
| 3,575,418 | 4/1971 | Palmer | 273/157 R |
| 4,336,020 | 6/1982 | Zacharin . | |
| 5,203,706 | 4/1993 | Zamir | 434/172 |
| 5,575,658 | 11/1996 | Barnard | 273/157 R |
| 5,716,212 | 2/1998 | Lee | 434/159 |

FOREIGN PATENT DOCUMENTS

| | | | |
|---|---|---|---|
| 1242975 | 8/1971 | United Kingdom | 273/157 R |

*Primary Examiner*—Steven Wong
*Attorney, Agent, or Firm*—Richard C. Litman

[57] ABSTRACT

A puzzle which includes a plurality of interlocking pieces, preferably made of heavy cardboard. The assembly of the pieces results in openings sized and shaped to receive specific letters. Letters, preferably of a different color than the other pieces, are then placed in the openings to spell a person's name. The inventive concept can be applied to different names.

4 Claims, 1 Drawing Sheet

FIG. 1
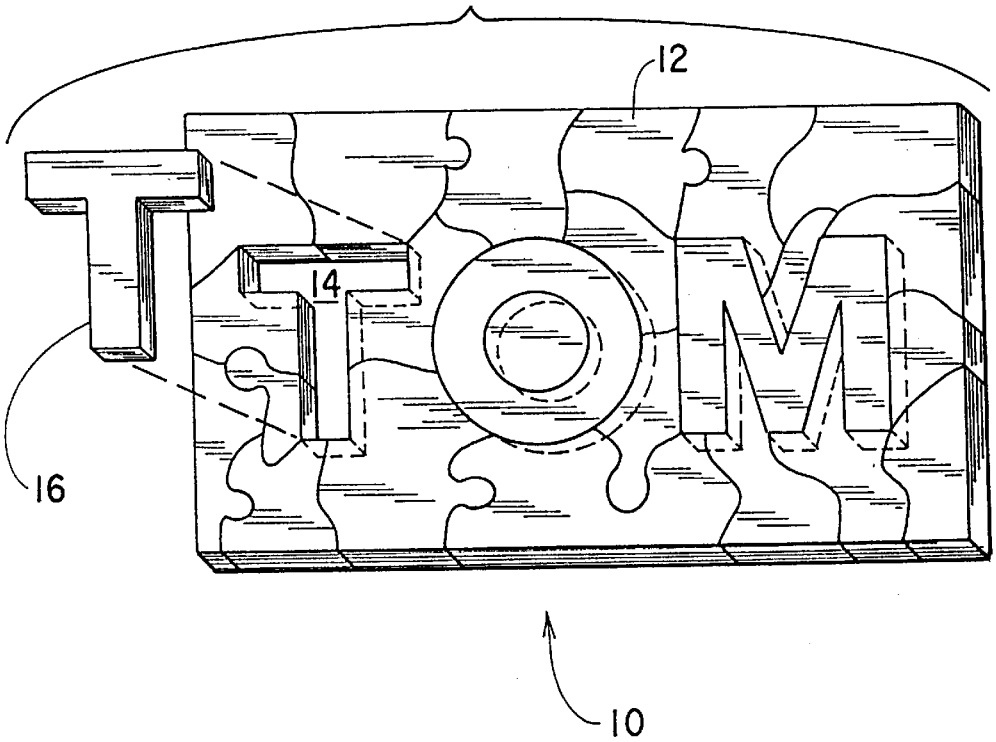
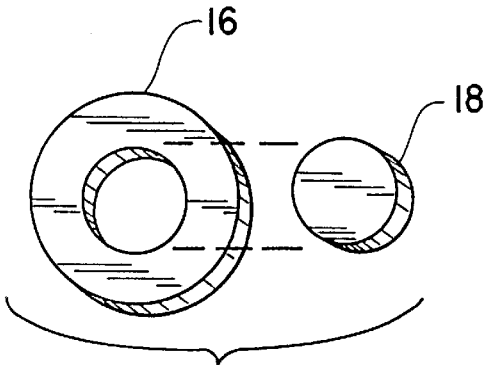
FIG. 2

PUZZLE

CROSS-REFERENCE TO RELATED APPLICATION

This application claims the benefit of U.S. Provisional Patent Application Ser. No. 60/048,527, filed Jun. 4, 1997.

BACKGROUND OF THE INVENTION

1. Field of the Invention

The present invention relates generally to puzzles and, more specifically, to a name puzzle.

2. Description of the Prior Art

The invention is a puzzle which includes a plurality of interlocking pieces, preferably made of heavy cardboard. The assembly of the pieces results in openings sized and shaped to receive specific letter pieces. Letters, preferably of a different color than the other pieces, are then placed in the openings to spell a person's name.

U.S. Pat. No. 1,230,263, issued on Jun. 19, 1917 to William H. S. Alexander, and U.S. Pat. No. 1,477,322, issued on Dec. 11, 1923 to T. M. Degheri, teach jigsaw puzzles in the shape of animals or other objects. U.S. Pat. No. 1,276,344, issued on Aug. 20, 1918 to M. A. Gilman, 1,854,999, issued on Apr. 19, 1932 to B. Ralls, and U.S. Pat. No. 4,336,020, issued on Jun. 22, 1982 to David Zacharin, teach puzzles having indicia such as words or numbers. None of the prior art, however, teaches the concept and structure of a jigsaw-type puzzle with through openings into which letters are inserted.

None of the above inventions and patents, taken either singly or in combination, is seen to describe the instant invention as claimed.

SUMMARY OF THE INVENTION

The invention is a name puzzle which includes several interlocking pieces and letters. Assembly of the interlocking pieces forms openings in which the letters, preferably of a different color and spelling a name, may be inserted. The inventive concept can be applied to different names.

Accordingly, it is a principal object of the invention to provide a puzzle which is both entertaining and educational.

It is another object of the invention to provide a high quality wooden puzzle which is personalized.

It is a further object of the invention to provide an educational product which will maintain a child's interest because it involves spelling the child's name.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is an exploded perspective view of the name puzzle and pieces; and

FIG. 2 is an exploded perspective view of a letter and an insert.

Similar reference characters denote corresponding features consistently throughout the attached drawings.

Detailed Description of the Preferred Embodiment

FIG. 1 shows a puzzle 10 which has a plurality of interlocking pieces 12. The assembly of these interlocking pieces 12 forms openings 14 into which letters 16 are inserted (as shown by the broken lines in the figure). The letters can be in any font, including that shown, or block script. These letters 16, which can be of a different color than the interlocking pieces 12, spell the name of a person. Under this inventive concept, puzzles can be constructed having interlocking pieces forming openings for receiving any letters. Thus, puzzles can be constructed to form any name.

FIG. 2 shows that letters 16 may have additional pieces 18. For example the letter "O" has an insert, and this may be a separate and differently colored piece.

The invention may be fabricated from any one of a wide variety of materials and the dimensions may also vary to meet particular needs. In one preferred embodiment, the dimensions of the puzzle can be 14 inches long, 8 inches wide and one-half inch thick. The material out of which the puzzle is made is heavy cardboard in this preferred embodiment. Of course, wood, plastic and other materials could be employed. The puzzle is particularly suitable for children ages one to four years. Quite obviously, the puzzle of this invention has recreational as well as educational value for the child.

It is to be understood that the present invention is not limited to the embodiments described above, but encompasses any and all embodiments within the scope of the following claims.

I claim:

1. A puzzle comprising letters and interlocking pieces, a plurality of said interlocking pieces cooperatively forming an opening shaped as one of said letters and for receiving one of said letters, all of said interlocking pieces forming a succession of openings, said letters being placed in said succession of openings to spell an intelligible word or name.

2. The puzzle of claim 1 wherein said letters have a surface color that is different than a surface color of said interlocking pieces.

3. The puzzle of claim 1 wherein said letters and said interlocking pieces are heavy cardboard.

4. The puzzle of claim 1 wherein said at least one of said letters has an insert that is placed into an opening in at least one of said letters, said insert being a separate and differently colored piece.

* * * * *